US005507433A

United States Patent [19]

Jardinier

[11] Patent Number: 5,507,433

[45] Date of Patent: Apr. 16, 1996

[54] METHOD AND DEVICE FOR ADJUSTING THE CROSS SECTION OF A VENTILATION AIR INLET IN PREMISES

[75] Inventor: Pierre C. J. Jardinier, Gournay Sur Marne, France

[73] Assignee: Conseils Etudes Et Recherches En Gestion De L'Air (C.E.R.G.A), Bussy Saint Georges, France

[21] Appl. No.: 286,195

[22] Filed: Aug. 8, 1994

[30] Foreign Application Priority Data

Aug. 10, 1993 [FR] France ..... 93 09995

[51] Int. Cl.[6] ..... G05D 22/00

[52] U.S. Cl. ..... 236/44 A; 236/91 C

[58] Field of Search ..... 236/44 R, 44 A, 236/91 C

[56] References Cited

U.S. PATENT DOCUMENTS

| | | | |
|---|---|---|---|
| 1,962,098 | 6/1934 | Zellhoefer | 236/44 A |
| 2,222,628 | 11/1940 | Newton | 236/44 A X |
| 3,718,280 | 2/1973 | Russell | 236/44 R |
| 3,930,612 | 1/1976 | Brakebill et al. | 236/44 R |
| 4,460,122 | 7/1984 | Jardinier | 236/44 A |

FOREIGN PATENT DOCUMENTS

| | | |
|---|---|---|
| 0240977 | 10/1987 | European Pat. Off. . |
| 2589996 | 5/1987 | France . |

*Primary Examiner*—William E. Tapolcai
*Attorney, Agent, or Firm*—Oliff & Berridge

[57] ABSTRACT

A method for adjusting an opening cross section of an air inlet into a premises involves sensing the amount of water vapor contained in the air inside of the premises and the amount of water vapor in the air outside of the premises. The opening cross section is adjusted on the basis of at least one of a difference between the amount of water vapor sensed the inside and outside the premises so that the opening cross section increases when the difference increases and independently of the amount of water vapor in the air outside the premises. A device for adjusting an opening cross section of an air inlet into a premises includes two chambers in communication respectively with the air outside and with the air inside the premises, the chambers being separated from one another by a heat exchanger, which is impervious to water vapor. Each chamber contains a bundle of fibers sensitive to humidity and is kept under tension by a spring and is connected by a driving mechanism to at least one flap for adjusting the cross section of the opening for inlet of air into the premises.

13 Claims, 4 Drawing Sheets

METHOD AND DEVICE FOR ADJUSTING THE CROSS SECTION OF A VENTILATION AIR INLET IN PREMISES

BACKGROUND OF THE INVENTION

The various rooms of a home have ventilation requirements which vary with respect to each other and also, for the same room, over time. This need changes in the main depending on the type of room and occupation thereof. As regards technical rooms, the ventilation need is essentially a function of the emissions of water vapors. As regards the main rooms, bedrooms and sitting-room, it is the number of individuals occupying these rooms which determines the level of ventilation required.

DESCRIPTION OF THE PRIOR ART

Currently, the most advanced technique in the management of ventilation needs makes it possible to slave the opening cross section of the air inlets and air outlets to the relative humidity of the rooms ventilated. For the air outlets, measuring relative humidity alone is sufficient, because the temperature in the rooms of a home varies very little and the emissions of water vapor in the technical rooms where these air outlets are placed are generally quite high.

The production of water vapor in the bedrooms and sitting-rooms, which are the rooms to which the air inlets relate, is mainly due to the respiration of the occupants. This production of water vapor is estimated to be between 40 and 80 grams of water per hour per individual depending on the metabolism and ambient conditions.

The rooms equipped with furniture, particularly curtains, carpets, rugs, exhibit a "buffer" behavior which attenuates variations in humidity which should be found if the emission of water vapor alone were considered.

The low amount of emissions of water vapor associated with the "buffer" behavior of the furnishings means that slight variations in humidity in the air have to be detected. Research has shown that the variation in relative humidity in a room occupied by two individuals and an empty room with standard furniture is of the order of 10 to 154, regardless of the season, in so far as the ventilation is carried out according to the legislation in force in France since 1982.

It should be considered that the function of the air inlets is not only to allow an intake of air, but also to distribute it in the best possible way to ventilate, in the main, the occupied rooms. It is therefore essential to detect slight variations between an occupied room and an empty room, in order to distribute the total flow rate extracted correctly. This is all the more so when operating with mechanical extraction alone, it being possible for slaving in the technical rooms to lead to a reduction in the total flow rate extracted, which it is essential to distribute into the occupied rooms, or else risk deteriorating the quality of the air in these rooms. Moreover, the amount of water vapor contained in the air outside varies greatly depending on the season. By way of example, approximately 4 grams per kg of air is recorded in January and 10 grams per kg of air is recorded in August, in Paris. When the air outside is brought to the temperature of a living room, which is more or less fixed right through the year, the resultant relative humidity may vary substantially. Thus, for an empty room:

4 grams of water per kg of air lead to 30% relative humidity at 20° C., 6 grams of water per kg of air lead to 40% relative humidity at 20° C., 8 grams of water per kg of air lead to 55% relative humidity at 20° C., 10 grams of water per kg of air lead to 70% relative humidity at 20° C.

SUMMARY OF THE INVENTION

The object of the invention is to provide a method and a device for adjusting the opening cross section of a ventilation air inlet in premises, which takes account of the humidity of the air outside and of the humidity of the air inside the premises, which depends also on the presence or absence of occupants in a room in order to alter the opening cross section of the air inlet.

To this end, the method to which it relates consists in slaving the opening cross section, on the one hand and in the main, to the difference between the amount of water vapor contained in the air of the premises and the amount of water vapor in the air outside, so that the opening cross section increases when this difference increases and, on the other hand, independently, to the amount of water vapor in the air outside.

This solution makes it possible to take account both of the amount of water contained in the air outside and of the amount of water contained in the air in the premises.

According to one feature, this method consists in measuring the relative humidities contained respectively in the air in the premises and in the air outside, at temperatures as close to one another as possible and which are largely independent of the temperature outside.

For the comparison between the two relative humidities respectively in the air in the premises and in the air outside to be coherent, it is important for the temperatures to be as close to one another as possible, because a difference of 1° C. in a temperature range around 20° C. leads to an error of 3% in relative humidity for a given amount of water in the air.

In order to ensure that the response is independent with respect to the temperature outside, it is also important for the relative humidities to be read at temperatures which are as close as possible to the temperature inside, the fluctuations of which are much smaller.

According to a first embodiment, the opening cross section of the air inlet is always the same for a given difference in humidity, regardless of the climatic conditions outside. The cross section of the opening increases only when the difference in the amounts of water vapor increases. This law governing variation in the opening cross section leads to a basic opening which is identical in summer and in winter, that is to say to a cross section which is identical when the amount of water vapor in the air outside varies.

According to another embodiment, this method consists in slaving the opening cross section, on the one hand, to the difference in the amount of water vapor contained in the air of the premises and the amount of water vapor in the air outside and, on the other hand, to the amount of water vapor in the air outside.

In this case, it involves taking account, not only of the difference between the amounts of water vapor contained respectively in the air of the premises and in the air outside, but also of the quantity of water vapor in the air outside.

In this case, the basic cross section of the opening will vary as a function of the amount of water vapor in the air outside, even if the difference between the amounts of water vapor contained in the air in the premises and in the air outside is zero.

According to a first possibility, this method consists in increasing the opening cross section when the amount of water vapor in the air outside increases.

This embodiment leads to a basic opening which is larger in the summer than in the winter in so far as, as indicated before, the amount of water vapor in the air outside is greater in the summer than in the winter.

According to another embodiment, this method consists in decreasing the opening cross section when the amount of water vapor in the air outside increases.

In this case, the basic opening is smaller in the summer than in the winter, in so far as the cross section of the inlet opening decreases when the amount of water vapor in the air outside increases. This latter embodiment may be of benefit in the case where the amount of water vapor in the air outside is very substantial, and where one wishes to isolate the premises from the air outside when the humidity outside increases and the premises are not occupied.

A device for the implementation of this method comprises two chambers in communication respectively with the air outside and with the air inside the premises. In order to ensure a stable temperature close to the temperature inside, the chambers may be situated in the room to be ventilated, and designed so that the additions of heat energy coming from the walls are much less significant than those coming from the air.

It is also possible to preheat the new air to a temperature close to the temperature inside, if the foregoing provision is insufficient. The chambers are separated from one another by a heat exchanger, which is impervious to the water vapor, ensuring a final balancing of their respective temperatures, the two chambers containing two bundles of fibers sensitive to relative humidity and kept under tension by a spring, and being connected by a driving mechanism to at least one flap for adjusting the cross section of the air inlet opening, the mechanism for driving the adjusting flap or flaps being controlled, on the one hand, by the relative movement of the two bundles and, on the other hand, by their overall movement.

According to one embodiment, one end of each bundle is stationary, whereas its other end is fitted, on the outside of the chamber containing the bundle of fibers in question, to a component in the form of a see-saw which, bearing on a spindle located at the end of the exchanger and with respect to which it can pivot, is connected directly or indirectly to at least one flap for adjusting the cross section of the air inlet opening.

The two bundles of fibers, for example textile fibers, exhibit the property of extending when the humidity increases and shortening when the humidity decreases. When the difference in humidity is balanced between the inside and the outside, and the humidity varies in the same way inside the premises as outside, the two bundles extend or shorten by the same amount. In contrast if, when the premises are occupied by individuals, the humidity increases inside the premises, the bundle of fibers subjected to the influence of the air inside the premises extends more than the other bundle, bringing about an inclination of the see-saw which is put to use to adjust the cross section of the opening for inlet of air into the premises.

According to a first embodiment, the end of at least one cable, the other end of which is attached to a flap fitted into the air inlet opening is attached to the component in the form of a see-saw.

In so far as one wishes to adjust the cross section of the opening for passage of the air by taking account, on the one hand, of the difference in humidity between the inside of the premises and the outside and, on the other hand, of the humidity outside, the ends of two cables are attached respectively to the component in the form of a see-saw and to the support of the latter, the other ends of which cables are fastened to two flaps fitted into the air inlet opening and articulated about the same spindle so that in one position they can be pressed flat against one another, one of these flaps being solid and the other including at least one central opening capable of being covered over to a greater or lesser extent by the first flap.

When the amount of water vapor contained in the air is the same in the premises and outside the latter, the two flaps are pressed flat against each other, and the basic opening is delimited between these two flaps and the inside wall of the duct. When the amount of water vapor inside the premises becomes greater than the amount of water vapor in the air outside, the solid flap tips with respect to the perforated flap, thus opening an additional passage inside the second flap in order to increase the cross section for passage of the air.

According to another embodiment of this device, the component in the form of a see-saw is secured to a lever acting on a valve for mixing two different air pressures, the pressure of the mixture being received inside a deformable bladder acting on a flap fitted into the air inlet opening.

Advantageously, the pressures inside and outside the premises are different, and are used to supply the mixer valve.

According to one possibility, the mixer valve comprises a piston, on one end of which there bears the lever attached to the component in the form of a see-saw, the piston including a transverse opening for placing two chambers at different pressures in communication with a chamber at the mixture pressure, the extent of this communication being adjustable depending on its axial position.

BRIEF DESCRIPTION OF THE DRAWING

In any case, the invention will be clearly understood with the aid of the description which follows, with reference to the appended diagrammatic drawing representing, by way of non-limiting examples, three embodiments of this device.

DESCRIPTION OF THE PREFERRED EMBODIMENTS

Figure 1:
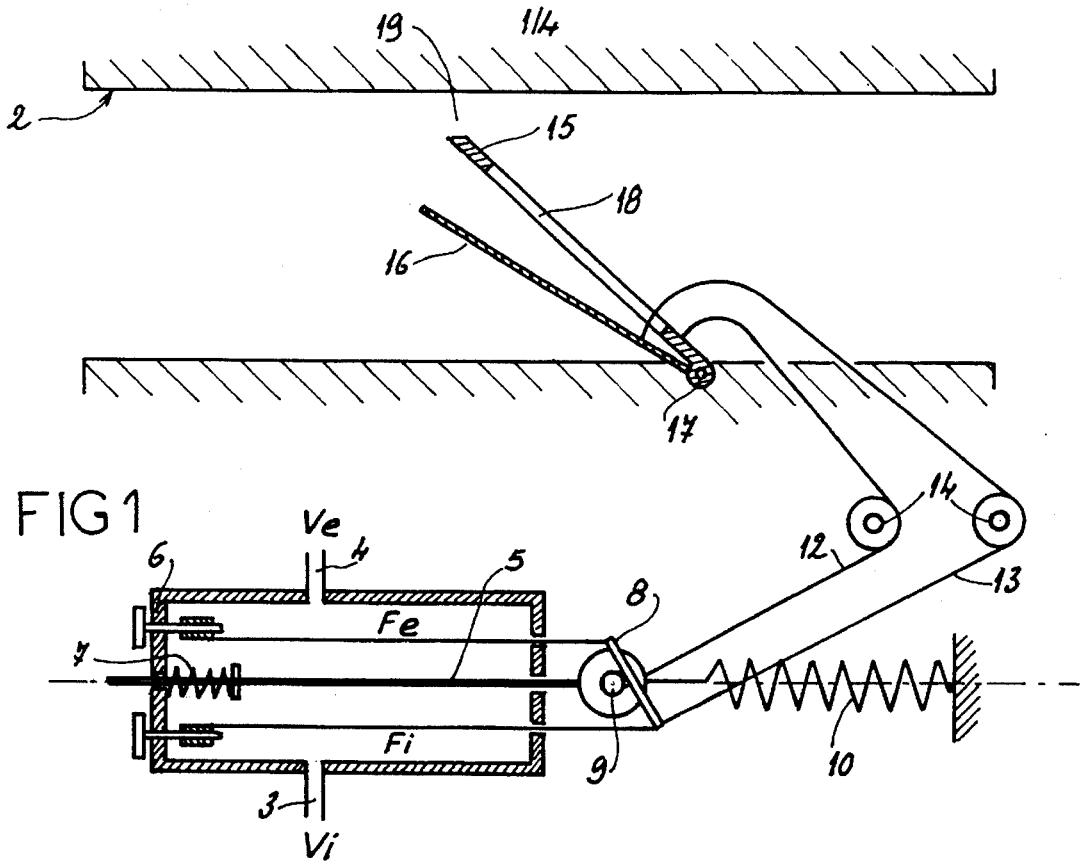
FIGS. 1 and 2 are two views of a first device in two operating conditions.

FIG. 1 represents a first device, in which the opening for inlet of air into a premises is denoted by the reference 2. This device comprises two chambers Vi and Ve, of which the one Vi is connected by a duct 3 to the inside of the premises to be ventilated, and of which the one Ve is connected by a duct 4 to the outside of the premises. These two chambers Vi and Ve are parallel, and separated from one another by a heat exchanger 5 so that the temperatures in the two chambers are as close to one another as possible. This heat exchanger 5 is fitted so that it slides through the support 6 situated close to one of the ends of the chambers, and held pushed toward the other end of the chambers, through which it also passes, by a spring 7.

Inside the two chambers Vi and Ve there are fitted two bundles Fi and Fe of textile fibers, sensitive to humidity. These two parallel bundles are attached at their end situated on the wall 6 side, and fitted at their other end, after passing through the front wall of the corresponding chambers, on to a component 8 in the form of a see-saw which bears on a spindle situated at the end of the heat exchanger 5, with the possibility of pivoting about this spindle. The two bundles Fi and Fe are held under tension by a spring 10. The ends of two cables 12 and 13 are attached respectively to the support of the see-saw 8 and to the see-saw 8, the other ends of which cables are attached, after passing over return pulleys 14, to two flaps 15 and 16 respectively. The flap 15 is articulated about a spindle 17 transverse to the axis of the opening 2, and includes a central opening 18. The flap 16 is articulated about the same spindle 17, and is capable of pivoting with respect to the flap 15 either to be pressed flat against it, or to form an angle with it and uncover the central opening 18 to a greater or lesser extent. The flap 15 defines the basic opening denoted by the reference 19 whereas the flap 16, in conjunction with the opening 18 in the flap 15, defines the additional cross section for passage of air, when there is a difference between the amounts of water vapor contained in the air inside the premises and in the air outside.

Figure 2:
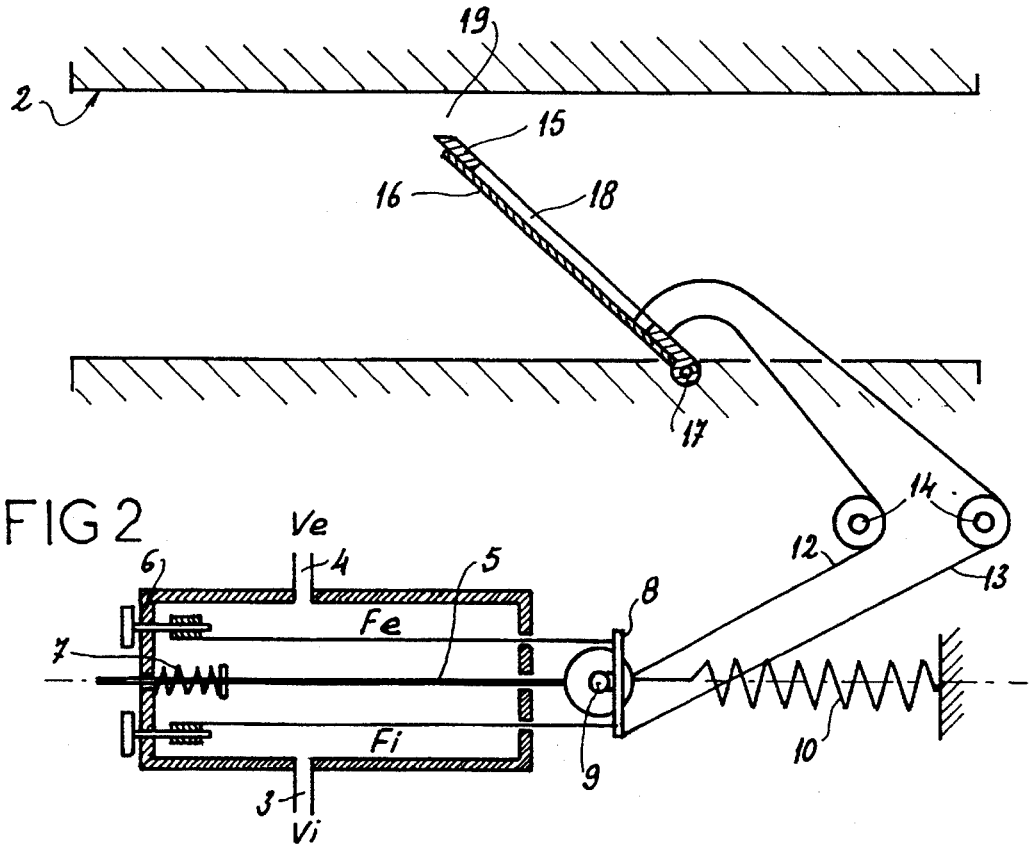

For as long as the amounts of air respectively inside the premises and outside are equal, the bundles Fi and Fe have the same length, as shown in FIG. 2, the only possible movement being one of translation parallel to the heat exchanger 5, in the event of a variation in humidity, by the same magnitude for the air outside and for the air inside. The basic opening 19 then varies as a function of this variation in humidity. If, on the contrary, the amount of water vapor inside the premises increases, that is to say that there is a difference with the amount of water vapor in the air outside, the bundle Fi extends more than the bundle Fe, which results, as shown in FIG. 1, in an imbalance and a rotation of the see-saw 8 about the spindle 9. This rotation is manifested by pivoting of the flap 16, which uncovers the opening 18 in the flap 15 to a greater or lesser extent, thus creating an additional air passage by comparison with the basic opening 19. When the amount of water vapor contained in the premises decreases, the bundle Fi contracts, and its length becomes equal to that of the bundle Fe again, which results in a relative pivoting movement of the flap 16 with respect to the flap 15, until it comes to bear one against this flap 15, when there is no longer any difference between the amounts of water vapor respectively in the premises and outside.

Figure 3:
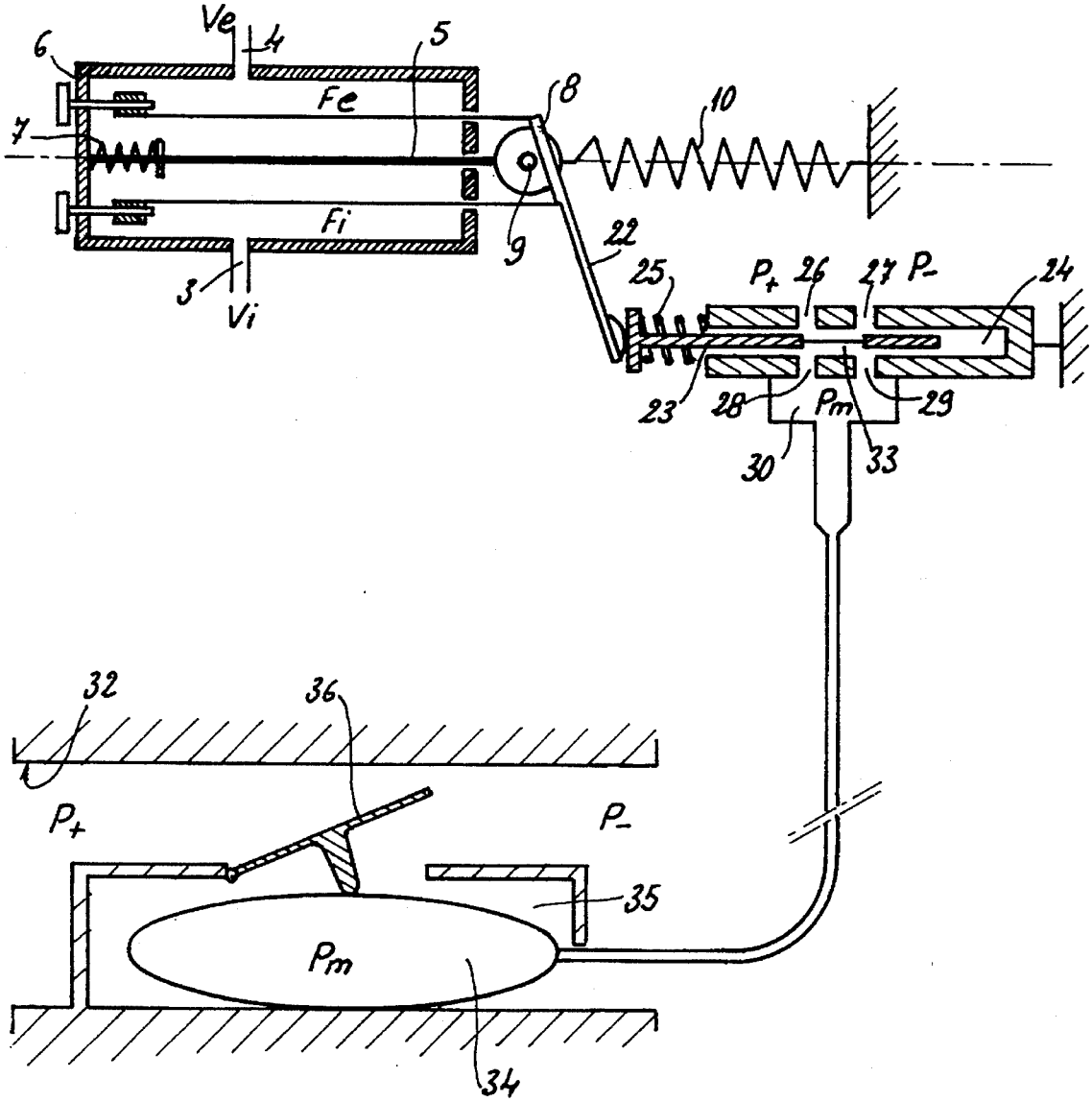
FIG. 3 is a diagrammatic view of a second device.

FIG. 3 represents another device, in which the same elements are denoted by the same references as before.

The operation of the bundles of fibers Fi and Fe is the same as in the case before, with pivoting of the see-saw 8 when there is an imbalance between the amounts of water vapor inside the premises and outside. This second device aims to provide a different treatment of the information received by the see-saw 8. For this purpose, the see-saw is secured to a lever 22, the free end of which bears against the crown of a piston 23 fitted so that it slides inside a cylinder 24, and which is subjected to the action of a spring 25 keeping this piston crown pressed flat against the lever 22. In one wall of the cylinder 24 there are formed two orifices 26 and 27 parallel to one another, and in the opposite wall are formed two corresponding orifices 28 and 29, respectively emerging into a mixing chamber 30. In this device, an air duct 32 is used, in which there prevails a pressure which is positive with respect to the room to be ventilated, of the order of 10 to 40 Pa. There is a pressure P+ in the upstream part of the air supply duct, and a pressure P− downstream of the latter, which may either be the pressure of the premises to be ventilated or a negative pressure obtained by means of a Venturi effect device placed between the duct 32 and the premises to be ventilated. The orifices 26 and 27 of the cylinder 24 are fed respectively with the pressure P+ and the pressure P−. A transverse opening 33 is formed in the piston 23 to allow air to pass respectively from the orifices 26 and 27 toward the mixing chamber 30. It goes without saying that depending on the position of the opening 33 in the piston 23, the pressures P+ and P− are not mixed in the same proportions, which has an influence on the value of the mixture pressure Pm in the mixing chamber 30. This mixture pressure also depends on the geometry of the cylinder and the passage cross sections of the orifices 26 and 27.

The mixture pressure Pm is injected into a flexible bladder 34 situated in a volume 35 in communication with the premises to be ventilated. When it is the pressure P+ which is injected into the bladder 34, the latter is inflated, and the flap 36 closes off the air supply duct 32. If, in contrast, the pressure P− is injected into the flexible bladder 34, the flap 36 is pushed back by the pressure P+ prevailing upstream of the duct 32, producing complete opening of this flap. The injection of an intermediate mixture pressure Pm makes it possible to position the flap 36 so as to obtain the desired cross section appropriate to the difference in humidity between the air inside the premises and the air outside the latter.

When the two bundles Fi and Fe extend or contract simultaneously, the translational movement of the lever 22 is imparted directly to the piston 23 without an amplification phenomenon. In contrast, when there is a differential extension of the two bundles Fi and Fe, the rotational movement of the see-saw 8 brings about an amplification of the translational movement of the piston 23.

Figure 5:
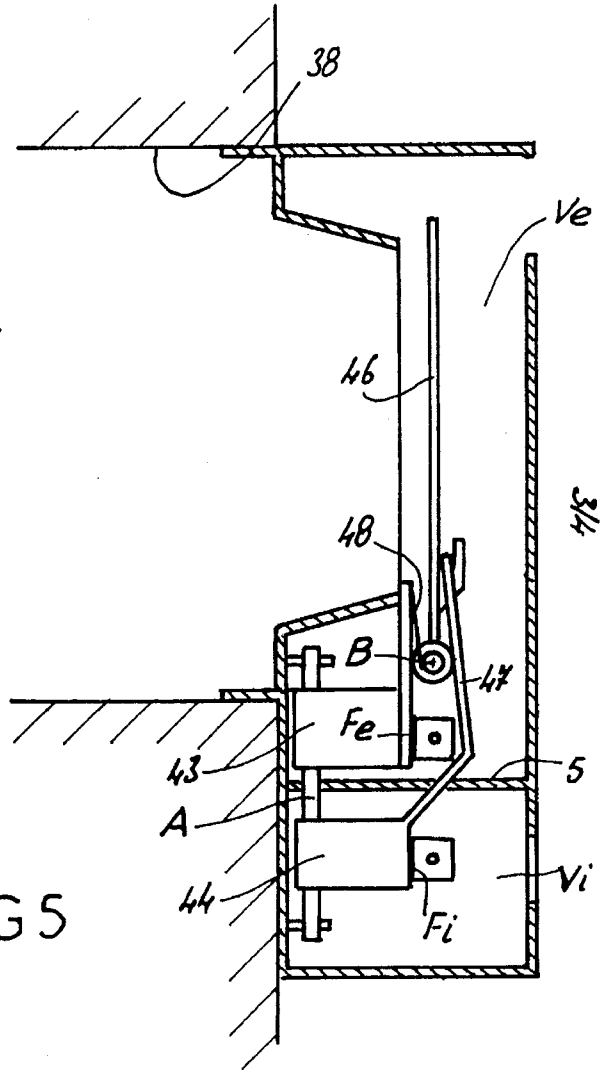
FIG. 5 is a sectional view of the device of FIG. 4.
Figure 4:
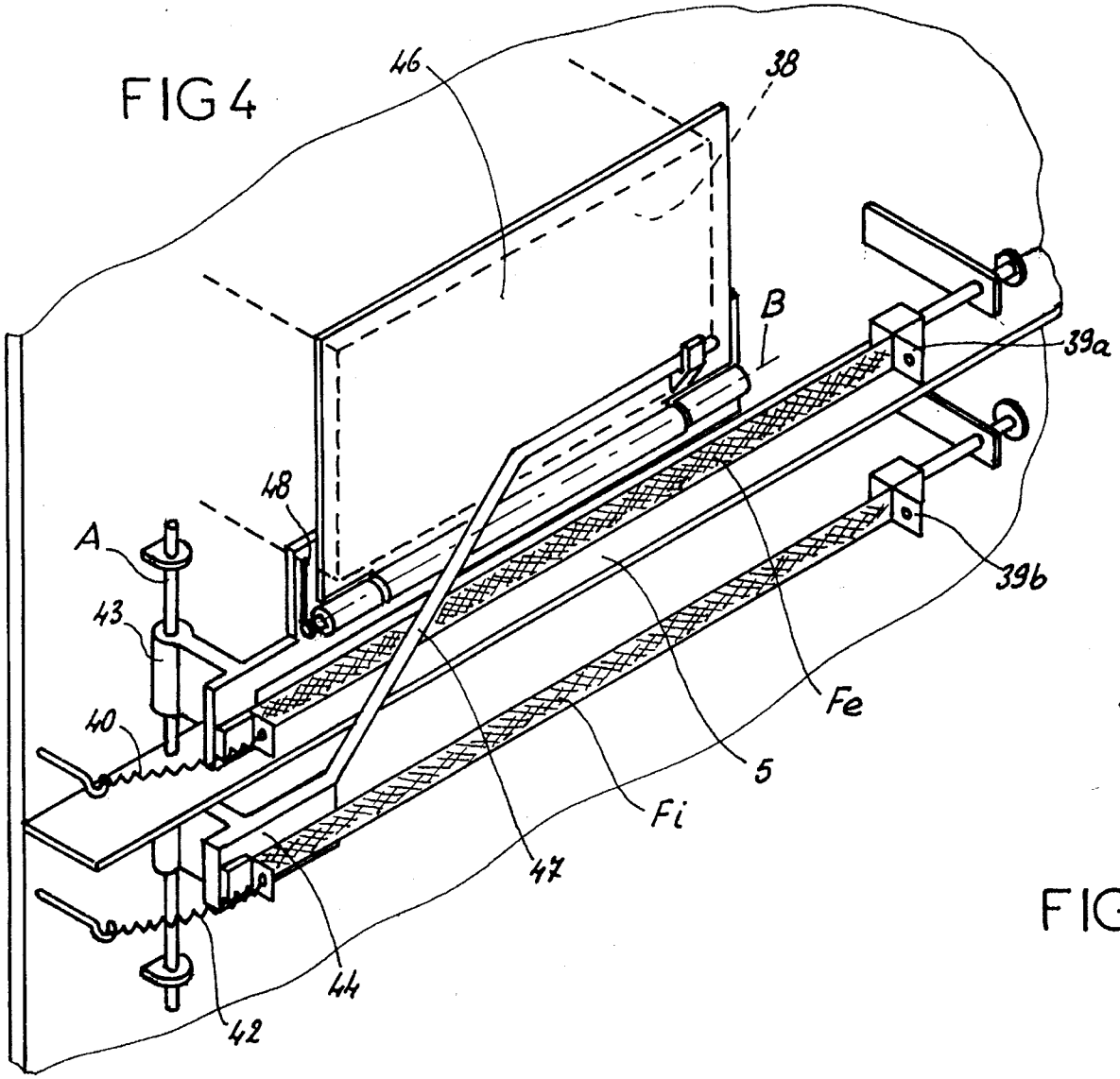
FIG. 4 is a perspective view of a third device.

FIGS. 4 and 5 represent a third device in which the same elements are denoted by the same references as before.

In this case, the two bundles of fibers Fe and Fi are located parallel to one another in two chambers Ve and Vi in communication respectively with the air outside and the air inside. These two chambers are separated by an impervious wall 5, which nevertheless allows heat exchange, so that the temperatures in these two chambers are as close as possible. The two bundles Fe and Fi are substantially parallel to the opening of a duct 38 the opening of which may be closed off to a greater or lesser extent by a flap 46. Each of the two bundles of fibers is attached, at one of its ends, to a stationary point **39*a* or 39*b*. At its other end, subjected to the action of a spring 40, 42 respectively, each bundle Fe, Fi is fitted on to a component 43, 44. The two components 43, 44 are fitted so that they pivot about an axis A common to the two components, which are perpendicular to the two bundles of fibers Fe, Fi and are parallel to the plane of the opening of the duct 38**.

The component 43 for attaching the bundle Fe, situated in the chamber Ve in communication with the air outside, also has a spindle B for articulation of the flap 46, substantially parallel to the bundle of fibers Fe, Fi. For its part, the component 44 for attaching the bundle Fi carries the end of a lever 47, the other end of which is fitted onto the outside face of the flap 46. When the amounts of water vapor in the air inside the room and outside the latter are equal, the bundles Fi and Fe have the same length, and the only possible movement for the flap 46 is pivoting about the spindle A. The more the bundles Fe, Fi extend, the more the flap 46 opens and uncovers a significant passage cross section.

When the amount of water vapor inside is greater than the amount of water vapor outside, which is the case when a room is occupied by individuals, the bundle Fi extends more than the bundle Fe, the component 44 pivots more than the component 43, and rotationally drives the flap about the spindle B, which further increases the cross section for passage of the air. It is possible to obtain an appropriate adjustment of the device taking account of the distance between that end of the lever 47 which is associated with the flap 46 and the spindle A, as well as between the distance between this same end and the spindle B.

When the amount of water vapor inside decreases, the lever 47 pushes the flap back by rotation of the latter about the spindle B and allows the passage cross section to reduce.

A spring 48 returning the flap 46 to the closed position makes it possible to maintain a minimal opening while compensating for the pressure in the air supply duct. Likewise, it is possible to compensate for the weight of the flap when the inlet is placed in a horizontal position, for example in a ceiling.

Figure 6:
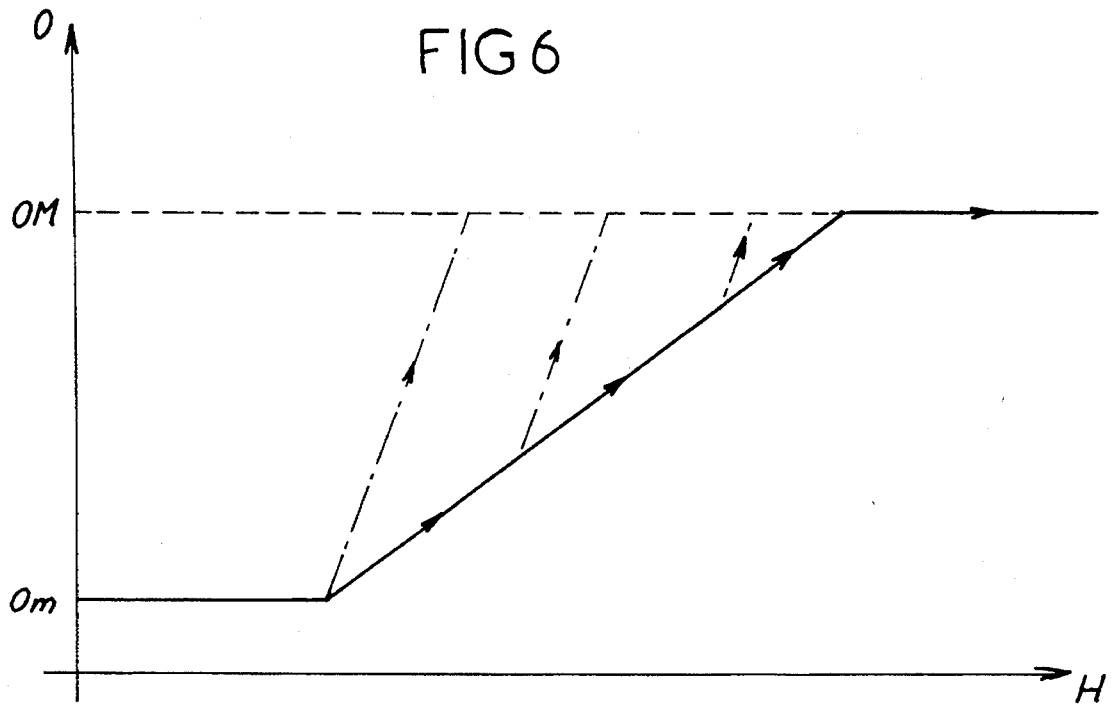
FIG. 6 is a view of an operating diagram for an air inlet opening equipped with the device according to the invention.

FIG. 6 represents an operating diagram for an air inlet opening equipped with the device according to the invention. In this diagram, the abscissa axis indicates the amount of water vapor H, whereas the ordinate axis indicates the extent of the opening 0 of the air inlet. This opening can vary between a minimal opening Om and a maximum opening OM. The curve in solid line indicates the overall movement, that is to say when the amount of water vapor inside the premises is equal to the amount of water vapor outside, which corresponds to a rotation about the spindle A in the last device described. The lines in mixed strokes indicate the possibility for additional opening of the flap by rotating it about the spindle B in the last device described, when the amount of water vapor inside the premises is greater than the amount of water vapor in the air outside.

As emerges from the foregoing, the invention provides a great improvement to the existing technique, whilst supplying a device of simple design making it possible to ventilate premises taking account of the occupation of these, acting upon the difference between the amount of water vapor in the air inside the premises and of water vapor contained in the air outside.

As goes without saying, the invention is not limited simply to the embodiments of this device which have been described hereinabove by way of examples, in contrast it encompasses all variants thereof.

Thus in particular, the means for detecting the amount of water vapor inside the premises and outside these could be different and made up not of bundles, the variation of whose length is exploited, but by hygrometers of some other type, or the heat exchanger between the two chambers for measuring humidity could be different without thereby departing from the scope of the invention.

I claim:

1. A method for adjusting an opening cross section of an air inlet into a premises, the method comprising the steps of:

sensing the amount of water vapor contained in the air inside of the premises and the amount of water vapor in the air outside of the premises; and adjusting the opening cross section on the basis of at least one of a difference between the sensed water vapor in the air inside of the premises and the sensed water vapor in the air outside of the premises so that the opening cross section increases when the difference increases and independently of the amount of water vapor in the air outside of the premises.

2. The adjusting method as claimed in claim 1, wherein the step of sensing includes sensing the relative humidities contained respectively in the air inside the premises and in the air outside, at temperatures as close to one another as possible and which are largely independent of the temperature outside.

3. The method as claimed in claim 1, wherein the step of adjusting includes increasing the opening cross section when the amount of water vapor in the air outside increases.

4. The method as claimed in claim 1, wherein the step of adjusting includes decreasing the opening cross section when the amount of water vapor in the air outside increases.

5. A device for adjusting a cross section opening of an air inlet into a premises, comprising:

two chambers in communication, respectively, with the air outside and with the air inside the premises, the chambers being designed so that heat exchanges through the walls are much more significant than through air, the chambers being separated from one another by a heat exchanger, which is impervious to water vapor, ensuring a balancing of respective temperatures of the two chambers, each chamber containing a bundle of fibers sensitive to humidity and kept under tension by a spring, and being connected by a driving mechanism to at least one flap for adjusting the cross section of the opening for inlet of air into the premises, the driving mechanism being controlled by at least one of the relative movement of the two bundles and the overall movement of the two bundles.

6. The device as claimed in claim 5, wherein one end of each bundle is stationary, and another end is to a component bearing on a spindle located at the end of the exchanger and with respect to which it can pivot, is connected directly or indirectly to at least one flap for adjusting the cross section of the air inlet opening.

7. The device as claimed in claim 6, wherein one end of at least one cable is attached to the component and an opposite end of the at least one cable is attached to the at least one flap fitted in the air inlet opening.

8. The device according to claim 7, wherein the device includes two cables and two flaps, one end of each of the two cables is attached to one of the two flaps fitted in the air inlet opening, the two flaps being articulated about a common spindle so that in one position the flaps can be pressed flat against each other, one of the flaps being solid and the other including at least one central opening capable of being closed off to a greater or lesser extent by the other flap.

9. The device as claimed in claim 6, wherein the component is secured to a lever acting on a valve for mixing two different air pressures, the pressure of the mixture being received inside a deformable bladder acting on a flap fitted in the air inlet opening.

10. The device as claimed in claim 9, wherein the pressures inside and outside the premises are different, and are used to supply the valve.

11. The device as claimed in claim 9, wherein the valve comprises a piston, on one end of which the lever bears, the piston including a transverse opening to place the two chambers at difference pressures in communication with a chamber at the mixture pressure, the extent of communication being adjustable depending on the axial position of the piston.

12. The device as claimed in claim 6, wherein each bundle of fibers sensitive to humidity is attached at one end to a stationary point and at another end, subject to the action of a spring, to a component fitted so that the component can pivot about a first spindle, the first spindle being common to the two components, and perpendicular to the two bundles of fibers and parallel to a plane of the opening of the air inlet, the component for attaching the bundle situated in the chamber in communication with the air outside also carrying a second spindle for articulation of the flap for adjusting the passage cross section of the air inlet, the second spindle being substantially parallel to the bundles of fibers, whereas the component for attaching the bundle situated in the other chamber carries an end of a lever, an opposite end of the lever being fitted to an outside face of the flap.

13. The device as claimed in claim 12, wherein the flap is equipped with a return spring to maintain a minimal opening by compensating for the pressure in the air supply duct.

* * * * *